US006008714A

United States Patent [19]

Okuda et al.

[11] Patent Number: 6,008,714

[45] Date of Patent: Dec. 28, 1999

[54] THIN-STRUCTURED ELECTROMAGNETIC TRANSDUCER

[76] Inventors: Masanao Okuda, 1864-11, Tomizuka-cho, Hamamatsu, Shizuoka 432; Tadashi Yoshino, 155-33, Sunayama-cho, Hamamatsu, Shizuoka 430, both of Japan

[21] Appl. No.: 09/180,595

[22] PCT Filed: Nov. 13, 1997

[86] PCT No.: PCT/JP97/04138

§ 371 Date: Nov. 10, 1998

§ 102(e) Date: Nov. 10, 1998

[87] PCT Pub. No.: WO99/26451

PCT Pub. Date: May 27, 1999

[51] Int. Cl.[6] ..... H01F 5/00; H01F 7/08

[52] U.S. Cl. ..... 336/200; 335/221; 335/222

[58] Field of Search ..... 335/222, 221; 381/99, 117

[56] References Cited

U.S. PATENT DOCUMENTS

| | | | |
|---|---|---|---|
| 4,653,103 | 3/1987 | Mori | 381/199 |
| 5,283,836 | 2/1994 | Trufitt | 381/199 |

FOREIGN PATENT DOCUMENTS

| | | |
|---|---|---|
| 49-51929 | 5/1974 | Japan . |
| 51-38432 | 3/1976 | Japan . |
| 52-92507 | 8/1977 | Japan . |
| 62-160900 | 7/1987 | Japan . |
| 1-153796 | 10/1989 | Japan . |
| 1 428 405 | 3/1976 | United Kingdom . |
| 1 545 517 | 5/1979 | United Kingdom . |

*Primary Examiner*—Michael L. Gellner
*Assistant Examiner*—Anh Mai
*Attorney, Agent, or Firm*—Wenderoth, Lind & Ponack, L.L.P.

[57] ABSTRACT

A thin electromagnetic transducer includes a permanent magnetic plate, a vibratory diaphragm disposed in opposing relation to the permanent magnetic plate, a resilient buffer member interposed between the vibratory diaphragm and the permanent magnetic plate, and a support member for regulating the position of the vibratory diaphragm relative to the permanent magnetic plate. The permanent magnetic plate is of rigid structure, having a parallel striped multipolar magnetized pattern and a plurality of air-discharge through-holes are arranged in neutral zones of the magnetized pattern. The vibratory diaphragm is formed of a thin and soft resin film on which a coil is formed by printing. A linear portion of the conductor pattern is disposed in a position corresponding to the neutral zones of the permanent magnetic plate, and the vibratory diaphragm is supported such that the vibratory diaphragm can displace in a thickness-wise direction. The resilient buffer member is formed of generally same sized sheets as the vibratory diaphragm, which are soft and have high air-permeability.

6 Claims, 5 Drawing Sheets

THIN-STRUCTURED ELECTROMAGNETIC TRANSDUCER

TECHNICAL FIELD

This invention relates to an electromagnetic transducer of a thin-structured type, and more particularly to a thin-structured electromagnetic transducer including a multipolar permanent magnetic plate of a rigid structure, a vibratory diaphragm having a serpentine coil pattern disposed in spaced opposing relation to the permanent magnetic plate, and a resilient buffer element interposed between the permanent magnetic plate and the vibratory diaphragm. Such a thin type electromagnetic transducer is advantageously used, for example, in planar loudspeakers, headphones, microphones, or other devices of a similar nature.

BACKGROUND OF THE INVENTION

Planar electromagnetic transducers comprised of a combination of a permanent magnet (s) and a vibratory diaphragm are known.

An electromagnetic transducer of this type normally includes a permanent magnet assembly, a vibratory diaphragm disposed in opposing relation to the permanent magnet assembly, and a support member for fixing the vibratory diaphragm to the permanent magnet assembly at a peripheral region thereof.

A permanent magnet assembly used in the conventional electromagnetic transducers of this type has a plurality of elongated permanent magnets each having two opposite poles (vertical magnetizing of the assembly) on the surface of both sides thereof, which magnets are arranged in parallel relation such that N-poles and S-poles appear alternately and fixedly jointed together by a non-magnetic component member. The vibratory diaphragm is a thin resin film, on a surface of or within which a coil comprised of a serpentine conductor pattern is formed. The vibratory diaphragm is combined with the permanent magnet assembly such that a linear portion of the conductor pattern will be located right on the central region between the elongated permanent magnets which are arranged in parallel relation. In actual practice, the vibratory diaphragm is fixed to the permanent magnet assembly at a peripheral region thereof through a spacer (s).

A magnetic line of force runs between magnetic poles of two adjacent elongated permanent magnets, and a magnetic field is developed in such a manner as to transverse the linear portion of the conductor pattern of the vibratory diaphragm. When the coil of the vibratory diaphragm is energized, an electromagnetic force is generated in accordance with Fleming's left-hand rule and the vibratory diaphragm is displaced in a thickness-wise direction thereof. According to this rule, vibrations corresponding to the drive current to the coil are generated to create an acoustic wave. This acoustic wave passes through the elongated permanent magnets so as to be radiated outside.

In the conventional permanent magnet assembly, it is desirable to arrange the elongated permanent magnets as densely as possible in order to enhance the efficiency. However, in case the permanent magnet to be used is a sintered magnet (ferrite magnet), for example, the more the effort to form the permanent magnet into an elongated design is increased, the more difficulty is encountered to form it with a precise accuracy (deformation such as warp tends to occur during sintering). Also, it becomes increasingly difficult to provide a sufficient mechanical strength. Moreover, since a large magnitude of magnetic force interacts between the elongated permanent magnets, an extremely difficult work is accompanied in bringing the elongated permanent magnets closer to each other for an accurate assembly. There is another problem in that since the individual elongated permanent magnets are held in their separated states, magnetic poles appear not only on the thickness-wise both sides thereof but also edge portions between the upper and lower surfaces and the side surfaces and a part of the side surfaces, and a magnetic flux jumps laterally between the approaching elongated permanent magnets, with the result that the number of the magnetic lines of force interlinked with the coil of the vibratory diaphragm (that is, a linear portion of the conductor pattern) is undesirably reduced and the driving efficiency is degraded.

As a consequence, the large number of elongated permanent magnets must be mutually arranged at large spaces. For this reason, it becomes necessary to form a large space between the permanent magnet assembly and the vibratory diaphragm. This again degrades the transforming efficiency and increases the thickness of the electromagnetic transducer as a whole.

In the conventional technique, since there is employed a construction in which the vibratory diaphragm is firmly pressed at its peripheral region with a spacer(s), a support point (fulcrum) is created at the peripheral region. As a consequence, somewhat awkward vibrations are generated. This makes it difficult to reproduce high fidelity sounds with respect to the drive current. Moreover, a large amplitude is difficult to obtain.

DISCLOSURE OF THE INVENTION

It is, therefore, an object of the present invention to provide an electromagnetic transducer which is capable of obviating the above-mentioned shortcomings inherent in the prior art device, easy to manufacture, and easy to be formed into a thinner design.

Another object of the present invention is to provide a thin-structured electromagnetic transducer, in which generation of foreign sounds (noises) caused by resonance at the peripheral region of the vibratory diaphragm is reduced to allow the vibratory diaphragm to freely vibrate, both locally and wholly, so that a large vibration amplitude can be obtained and high fidelity sounds to a drive current can be output.

The present invention provides a thin-structured electromagnetic transducer including a permanent magnetic plate, a vibratory diaphragm disposed in opposing relation to the permanent magnetic plate, a resilient buffer element interposed between the vibratory diaphragm and the permanent magnetic plate, and a support member for regulating a position of the vibratory diaphragm relative to the permanent magnetic plate.

The permanent magnetic plate is of rigid structure in which a parallel striped multipolar magnetized pattern where strip N-poles and strip S-poles appear alternately is formed generally over an entire surface of the permanent magnetic plate opposing the vibratory diaphragm and a plurality of air-discharge through-holes are arranged in neutral zones of the magnetized pattern.

The vibratory diaphragm is formed of a thin and soft resin film on which a coil comprised of a serpentine conductor pattern is formed by printing, a linear portion of the conductor pattern being disposed in a position corresponding to the neutral zones of the permanent magnetic plate, the vibratory diaphragm being not affixed at a peripheral region thereof, the vibratory diaphragm being supported by the support member such that the vibratory diaphragm is restricted displacement in an in-plane direction but it can displace in a thickness-wise direction.

The resilient buffer member is formed of a plural plies of generally same sized sheets as the vibratory diaphragm, which are soft and have high air-permeability, a gap being formed between the sheets and the permanent magnetic plate, or between the sheets and the vibratory diaphragm.

It is preferred that the permanent magnetic plate and the resilient buffer member are disposed on each side of the vibratory diaphragm (though it may be disposed on one side of the vibratory diaphragm) in such a manner as to sandwich the vibratory diaphragm therebetween, and the permanent magnetic plates on both sides of the vibratory diaphragm are spacedly affixed, with the neutral zones being in alignment with each other and with the same poles being in mutually opposing relation. In that case, the permanent magnetic plate and the resilient buffer member are not necessarily required to be in symmetrical relation with respect to the vibratory diaphragm. Accordingly, the two permanent magnetic plates may be same in material and in configuration, or it may be different in material and in configuration (thickness). The permanent magnetic plate may be, for example, a sintered magnet, a plastic magnet, a metal magnet, or the like.

The serpentine-shaped (reciprocating) conductor pattern serving as the coil may be formed on only a single surface of the resin film or on double surfaces. A single conductor pattern may be formed or a plurality of conductor patterns may be provided in such a manner as to correspond to the center line of each neutral zone of the permanent magnetic plate. In case a plurality of conductor patterns are arranged in parallel relation in a single neutral zone, they must carefully be arranged in perfect symmetrical relation with respect to the center line. In all cases, it is necessary that a parallel relation of position is maintained between the central line and the conductor pattern (s).

It is preferred that a magnetic flux leakage preventive magnetic plate having a high magnetic permeability (for example, an iron plate, a nickel-iron alloy, or the like) is in intimate contact with a surface of the permanent magnetic plate on the other side of the surface opposing the vibratory diaphragm. In that case, it becomes necessary that a plurality of air-discharge through-holes like the air-discharge through-holes formed in the permanent magnetic plate are formed in the magnetic plate having a high magnetic permeability such that the air-discharge through-holes in the permanent magnetic plate are in communication with the air-discharge through-holes in the magnetic plate having a high magnetic permeability, so that an acoustic wave generated inside is radiated outside smoothly.

Strip N-poles and strip S-poles appear alternately on the surface of the permanent magnetic plate by magnetizing. A vertical magnetic field component (absolute value) to the surface of the permanent magnetic plate becomes largest in the vicinities of the N-poles and S-poles, and smallest in the vicinities of the boundaries between the N-poles and S-poles. This occurs because the definition is made by viewing the magnetized magnetic field component in a vertical direction. Since no magnetic field of the vertical component exists in the vicinities of the boundaries between the N-poles and S-poles, those areas are called "neutral zones".

In contrast, with respect to the horizontal component (the component parallel to the surface of the permanent magnetic plate), it is smallest in the vicinities of the N-poles and the S-poles and largest in the vicinities of the boundaries (neutral zones) between the N-poles and the S-poles. This is also apparent from the fact that arcuate magnetic lines of force run from the N-poles to the S-poles adjacent thereto. The component, which can contribute to vibrate the vibratory diaphragm in the thickness-wise direction is not the vertical component but the horizontal one (Fleming's left-hand rule). The area where the horizontal component of the magnetic field acts most effectively is not the vicinities of the respective poles but the neutral zones as mentioned above. So, if the linear portion of the conductor pattern is disposed in position corresponding to the neutral zones, the magnetic lines of force run in a direction transversing the linear portion of the conductor pattern. Accordingly, with such a construction, when a drive current is supplied to the coil (conductor pattern), the electromagnetic force is most efficiently generated due to interaction between the electrical current and the magnetic field, and the vibratory diaphragm is vibrated in the thickness-wise direction. An acoustic wave generated as a result of this is discharged outside through the air-discharge through-holes formed in the permanent magnetic plates (and the magnetic plates having a high magnetic permeability). The foregoing is the sound producing principles of the electromagnetic transducer according to the present invention. The principles themselves of the electromagnetic transducer are the same as the conventional electromagnetic transducers of this type.

One of the features of the present invention resides in that a permanent magnetic plate of a rigid continuous structure (not such a structure as the one consisting of a combination of individual magnets), in which a parallel striped multipolar magnetized pattern is formed generally over an entire surface of the permanent magnetic plate and a plurality of air-discharge through-holes are arranged in neutral zones of the magnetized pattern, is used as a drive source.

Another feature of the present invention resides in that the vibratory diaphragm is not affixed at a peripheral region thereof, and it is supported by the support member such that the vibratory diaphragm can displace only in a thickness-wise direction.

A further feature of the present invention resides in that the resilient buffer member formed of a plural plies of generally same sized sheets as the vibratory diaphragm, which are soft and have high air-permeability, is disposed such that a gap is formed between the sheets and the permanent magnetic plate, or between the sheets and the vibratory diaphragm.

Other factors, such as whether the permanent magnetic plate is a sintered magnet or a non-sintered magnet, whether the magnet is a flexible magnet or a solid magnet, material (a ferrite magnet, a rare earth based magnet, neodymium-iron-boron based magnet, or the like), characteristics, thickness and shape (regular square, rectangular, circular, oblong, or the like), structure (whether the permanent magnetic plate consists of a single magnetic plate or plural plies of magnetic sheets, or the like) is a matter of design and therefore can be selected as desired. They can be appropriately selected in accordance with necessity in view of manufacture, state of use, or the like. The largeness of the magnetic poles (magnetization force), arrangement pitches of the poles, etc. are also a matter of choice. There is an acceptable construction in which the permanent magnetic plate is arranged to only one side or otherwise each side of the vibratory diaphragm. There is also another acceptable construction in which the vibratory diaphragms are arranged on both sides of the permanent magnetic plate such that the permanent magnetic plate is sandwiched between the vibratory diaphragms. The conductor pattern may be disposed on a single side or both sides of the resin film of the vibratory diaphragm. The vibratory diaphragm may consist of a plurality of resin films. A single (a turn) or a plurality (plural turns) of conductor patterns may be arranged in such a manner as to correspond to each neutral zone on the permanent magnetic plate.

BEST MODE FOR CARRYING OUT THE INVENTION

Preferred embodiments of the present invention will now be described with reference to the accompanying drawings.

Figure 1:
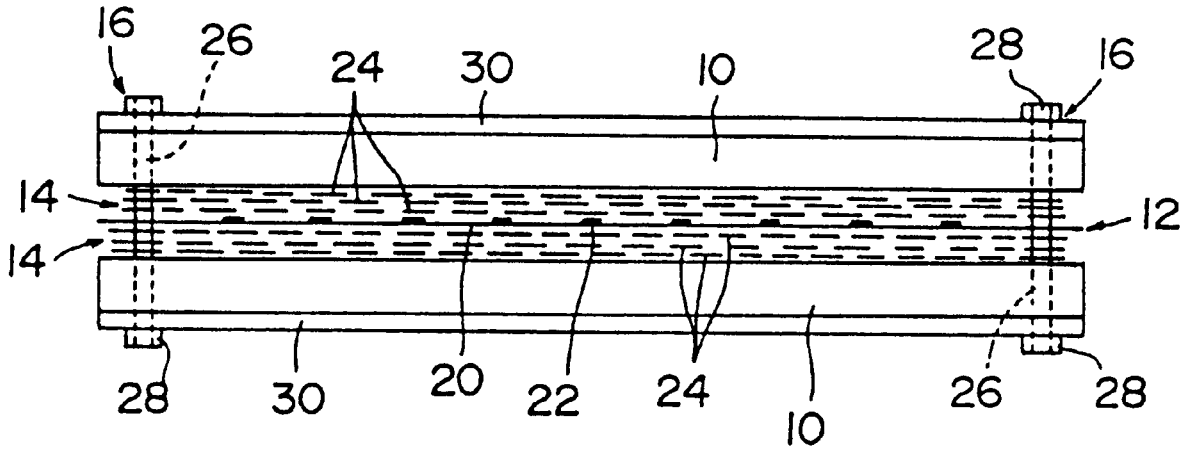
FIG. 1 is an explanatory view showing an overall construction of a thin-structued type electromagnetic transducer according to one embodiment of the present invention.
Figure 2:
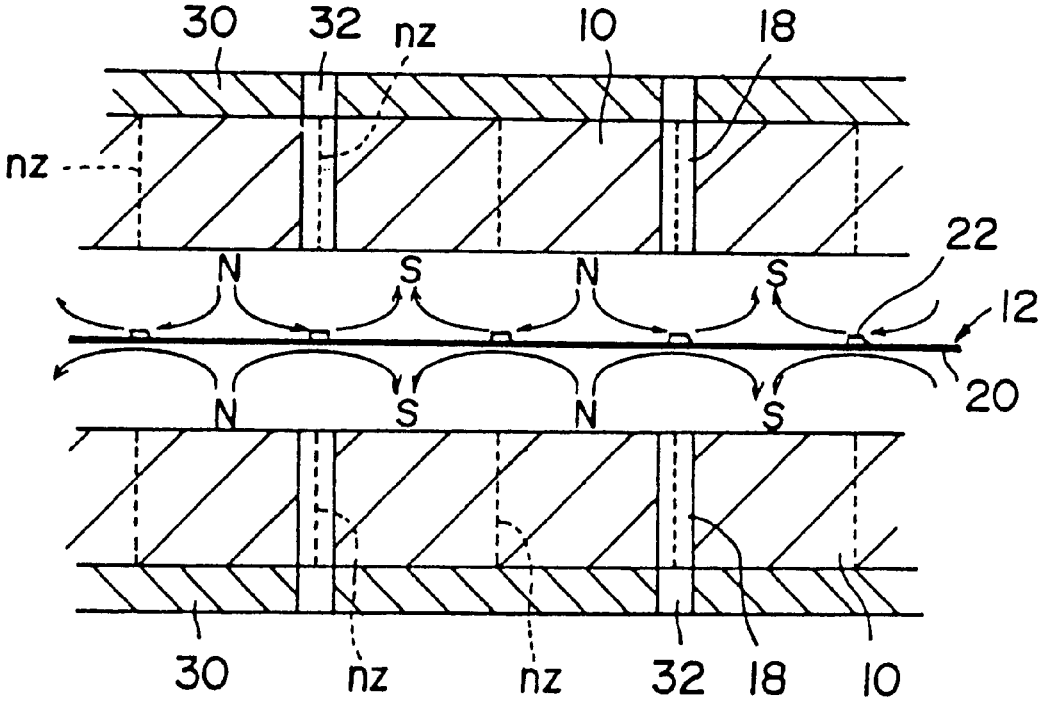
FIG. 2 is an enlarged view of a main part, showing a part of the overall construction of the electromagnetic transducer of FIG. 1 in an enlarged scale.

FIGS. 1 and 2 are explanatory views showing one embodiment of a planar loudspeaker as one kind of a thin type electromagnetic transducer according to the present invention. FIG. 1 shows an overall construction, and FIG. 2 shows its main portion, with a resilient buffer member (cushion member) omitted, in an enlarged scale. This planar loudspeaker includes permanent magnetic plates (two in this embodiment) 10, a vibratory diaphragm 12 disposed in opposing relation to the permanent magnetic plates 10, resilient buffer members 14 each interposed between the vibratory diaphragm 12 and each permanent magnetic plate, and support members 16 for regulating a position of the vibratory diaphragm 12 relative to the permanent magnetic plates 10. The same kinds of the permanent magnetic plates 10 and the resilient buffer members 14 are symmetrically arranged on the surfaces of the both sides of the vibratory diaphragm 12 in such a manner as to sandwich the vibratory diaphragm 12 therebetween.

Figure 3:
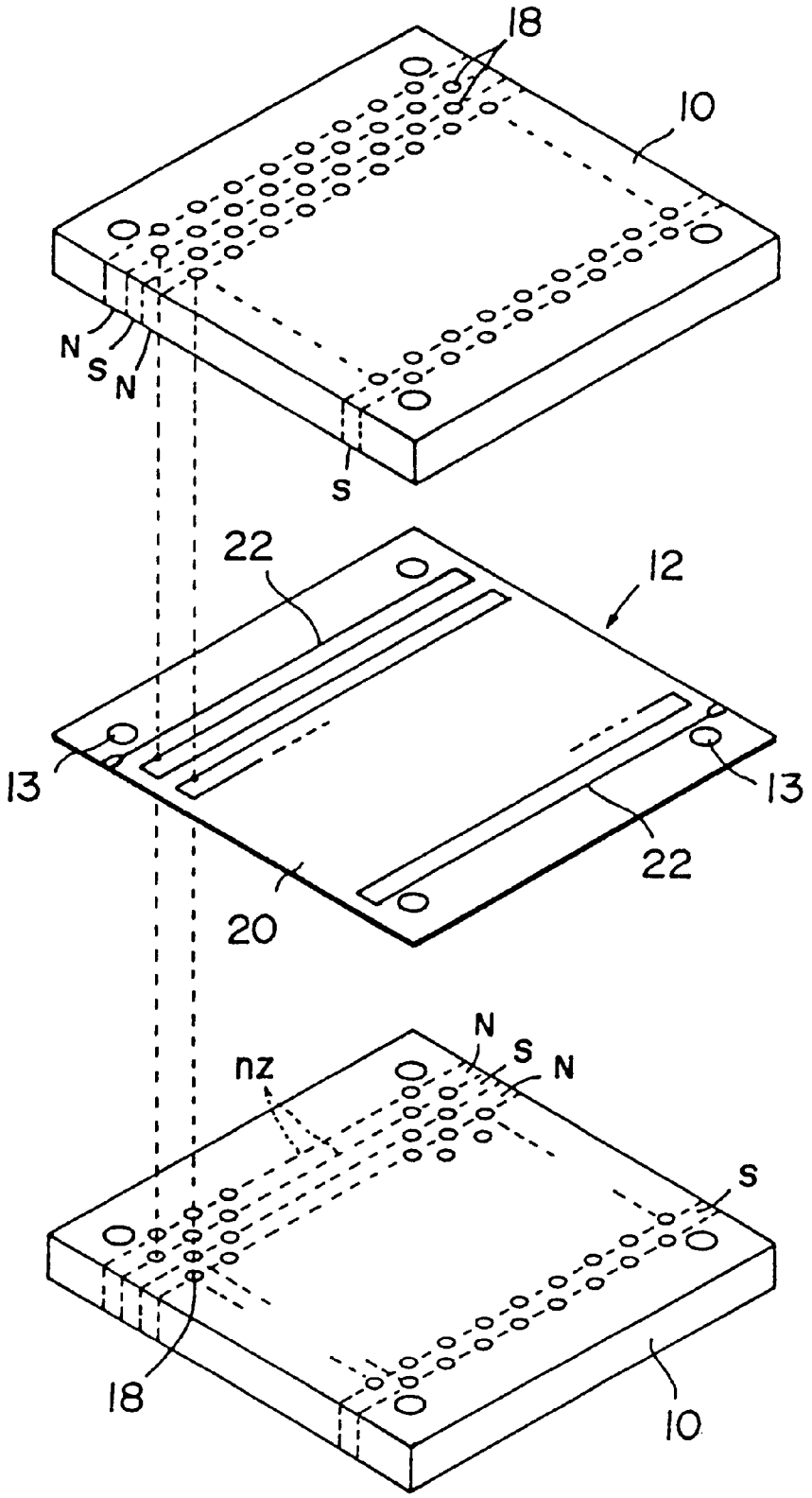
FIG. 3 is a perspective view showing the constructions of permanent magnet plates and a vibratory diaphragm, as well as their positional relationship.

As shown in FIG. 3, the permanent magnetic plates 10 are each of planar configuration of regular square, for example. They are each formed of a sintered ferrite magnet. The permanent magnetic plates 10 are of rigid structure in which a parallel striped multipolar magnetized pattern where strip N-poles and strip S-poles appear alternately are formed generally over their entire surfaces opposing the vibratory diaphragm 12 and a large number of air-discharge through-holes 18 are arranged in neutral zones nz of the magnetized pattern. The air-discharge through-holes 18 are formed at predetermined pitches along the neutral zones nz such that the air-discharge through-holes 18 of a certain neutral zone nz are offset by a half pitch from those of its adjacent neutral zones nz in staggered relation. The air-discharge through-holes may be arranged in a regular square lattice fashion so that the air-discharge through-holes 18 of a certain neutral zone nz are in registry with corresponding through-holes of the adjacent neutral zones nz. However, if they are arranged in this way, a distance between the air-discharge through-holes 18 is reduced and cracking tends to occur due to decrease in mechanical strength of the permanent magnetic plates. For this reason, the air-discharge through-holes 18 of a certain neutral zone nz are preferably arranged in staggered relation with those of the adjacent neutral zones nz. The shape of each discharge-air through-hole 18 may be circle or oblong. The dimensional shape of the discharge-air through-hole should be properly selected. After selected, the through-holes should be accurately arranged. If it is too small, an acoustic wave generated inside is not sufficiently radiated outside. In contrast, if it is too large, the permanent magnetic plates 10 are lowered in volume and the acting magnetic field becomes weak. In addition, their mechanical strength is also reduced.

Such permanent magnetic plates 10 can easily be manufactured by integrally forming plies of, for example, non-sintered perforated magnetic sheets and then sintering the same. In order to form a parallel striped multipolar magnetized pattern on the surface of the permanent magnetic plate, a magnetizing tool is used. This magnetizing tool has a plurality of yoke-shaped parallel narrow grooves with an electrical wire embedded therein. After the magnetizing tool is brought into intimate contact with the permanent magnetic plate, a pulse current is supplied thereto. By doing so, strip magnetic poles appear on the surface of the permanent magnetic plate. Thus, a parallel striped multipolar magnetized pattern is formed. In this case, those areas opposing the narrow grooves are served as the neutral zones.

As shown in FIG. 3, the vibratory diaphragm 12 is of a structure in which a coil 22 comprised of a serpentine conductor pattern is formed by printing on a thin and soft resin film 20 such as a biaxial oriented polyethylene terephthalate film (merchandise name: Mylar), or an aromatic polyimide film (merchandise name: Kapton) having a thickness on the order of 30 $\mu$m or less, for example. The linear portions of the coil 22 are arranged in position corresponding to the neutral zones nz of the permanent magnetic plates 10 and in parallel relation to the neutral zones nz. The vibratory diaphragm 12 is not firmly affixed at a peripheral region thereof. The vibratory diaphragm 12 is supported by the support members 16 such that the vibratory diaphragm 12 is restricted displacement in an in-plane direction but it can displace in a thickness-wise direction.

Reverting to FIGS. 1 and 2, the resilient buffer member 14 is formed of a plural piles of generally same sized sheets as the vibratory diaphragm 12, which are soft and have high air-permeability (an acoustic wave can permeate or pass therethrough). An appropriate gap is formed between the sheets and the permanent magnetic plate, or between the sheets and the vibratory diaphragm. The sheets 24 are preferably thin nonwoven fabrics and about three sheets (two to five) are inserted therebetween in superimposed relation. The expression "superimposed relation" used herein refers not to a state in that the sheets are superimposed in a bonded relation but they are merely roughly superimposed such that they can individually vibrate (displace). The thickness, material, and number of the nonwoven fabric can be changed depending on designing conditions, or the like. This resilient buffer member 14 has such functions as to prevent the vibratory diaphragm from hitting the permanent magnetic plate 10 in operation so as not to generate a foreign sound (noises other than normal vibration sound), and to prevent the vibratory diaphragm itself from generating splitting vibrations (prevention of an occurrence of rattling or trembling sound) in order to appropriately restrict a possible occurrence of other acoustic wave than fidelity sounds to a sound source. In FIG. 1, the resilient buffer member 14 formed of a nonwoven fabric is indicated by the broken line. This resilient buffer member 14 is comprised of plural plies of generally same sized sheets as the vibratory diaphragm as previously mentioned.

The two permanent magnetic plates 10 are retained by the support members 16. Each support member 16 consists of a combination of a support rod 26 provided on each of the four corners thereof and nuts 28 threadingly engaged with opposite ends of the support rod 26. The two permanent magnetic plates 10 are firmly mechanically fixed by the support members 16 so that they are held in a constant positional relation with a space therebetween. The vibratory diaphragm 12 interposed between the permanent magnetic plates 10 is formed in four corners thereof with holes 13 (see FIG. 3). The support rods 26 are inserted into the holes 13, respectively. Due to engagement with a strict accuracy of micron order, the vibratory diaphragm 12 is restricted displacement in an in-plane direction but it can displace in the thickness-wise direction. When the vibratory diaphragm 12 is displaced laterally so as to be offset from the magnetizing pattern of the permanent magnetic plate 10, it becomes difficult to generate an acoustic wave efficiently. To prevent this, the vibratory diaphragm 12 is supported such that the linear portions of the coil will not offset from the neutral zones. Also, in the case of a nonwoven fabric serving as the resilient buffer member, the same supporting structure may be employed, namely, holes are formed in the four corners and the support rods 26 are inserted therein. In any case, it is necessary that the resilient buffer member 14 can displace in the thickness-wise direction as in the vibratory diaphragm 12.

In this embodiment, a magnetic flux leakage preventive magnetic plate 30 having a high magnetic permeability is in intimate contact with a surface of the permanent magnetic plate 10 on the other side of the surface opposing the vibratory diaphragm 12, and a plurality of air-discharge through-holes 32 like the air-discharge through-holes 18 formed in the permanent magnetic plate 10 are formed in the magnetic plate 30 having a high magnetic permeability such that the air-discharge through-holes in the permanent magnetic plate 10 are in communication with the air-discharge through-holes 32 in the magnetic plate 30 having a high magnetic permeability. The magnetic plate 30 having a high magnetic permeability is preferably an iron plate, a nickel-iron alloy (permalloy) plate, or the like.

With the above-mentioned construction, the strip N-poles and the strip S-poles appear alternately on the surface (the surface opposing the vibratory diaphragm) of the permanent magnetic plate 10 thereby to define the parallel striped magnetizing pattern. Since the linear portion of the coils 22 of the vibratory diaphragm 12 are located in position corresponding to the neutral zones (boundary line between the N-poles and the S-poles), the magnetic lines of force runs in a plane of the vibratory diaphragm 12 in a direction transversing the linear portion of the coil 22 (an example of the magnetic lines of force is indicated by arrows of FIG. 2). Accordingly, when a drive current is supplied to the coil 22, an electromagnetic force is generated in the thickness-wise direction due to interaction between the electrical current and the magnetic field. The acoustic wave generated by this vibration is discharged outside through the air-discharge through-holes 18, 32 formed respectively in the permanent magnetic plate 10 and the magnetic plate 30 having a high magnetic permeability.

It is considered that acoustic waves are produced from local areas (fine areas in the linear portions of the coil 22) of the vibratory diaphragm 12. That is, the vibratory diaphragm 12 is not firmly secured at its peripheral portion (edge portion) and therefore, it can be displaced in the thickness-wise direction. Therefore, when a drive current flows through the coil 22, the vibratory diaphragm 12 is locally vibrated by the electromagnetic force in accordance with Fleming's left-hand rule. Combined vibrations of those local vibrations are recognized as a sound by a listener when they reach the ears of the listener. The reason why the peripheral region of the vibratory diaphragm 12 is supported in a free state is as follows. By doing so, such local vibrations are prohibited to be disturbed in the vicinity of the peripheral region, so that a fidelity acoustic transforming can be performed and the generation efficiency of acoustic wave can be enhanced in the transducer as a whole.

In the permanent magnetic plate 10, the magnetic lines of force are developed from a desired N-pole on its surface to the S-pole. As previously mentioned, the vertical component of the magnetic field is largest in the vicinities of the N-poles and the S-poles but smallest in the vicinities of the boundaries of the N-poles and the S-poles. By contrast, the horizontal component of the magnetic field is smallest in the vicinity of the N-poles and the S-poles, but largest in the boundaries of the N-poles and the S-poles. In case of a single permanent magnetic plate, the magnetic lines of force are generally concentrically developed. On the other hand, in the case of the above embodiment in which two permanent magnetic plates are arranged in opposing relation, since the same poles are faced with each other (N-pole is faced with N-pole, and S-pole is faced with S-pole) in the two permanent magnetic plates, the magnetic lines of force directing to the S-poles from the N-poles in one of the two permanent magnetic plates and the magnetic lines of force directing to the N-poles from the S-poles in the remaining permanent magnetic plate attempt to push each other as shown in FIG. 2 and are balanced at the central area, resulting in deformation such that the horizontal (direction passing through the in-plane) component is increased. Since such horizontal component contributes to generation of an acoustic wave, an opposing arrangement of such permanent magnetic plates is preferred because the conductor arrangement area can be enlarged, particularly in case the coil has plural turns (i.e., in case a plurality of conductor patterns are laid in a single neutral zone). Of course, the electromagnetic transforming efficiency is enhanced, too.

Figure 4:
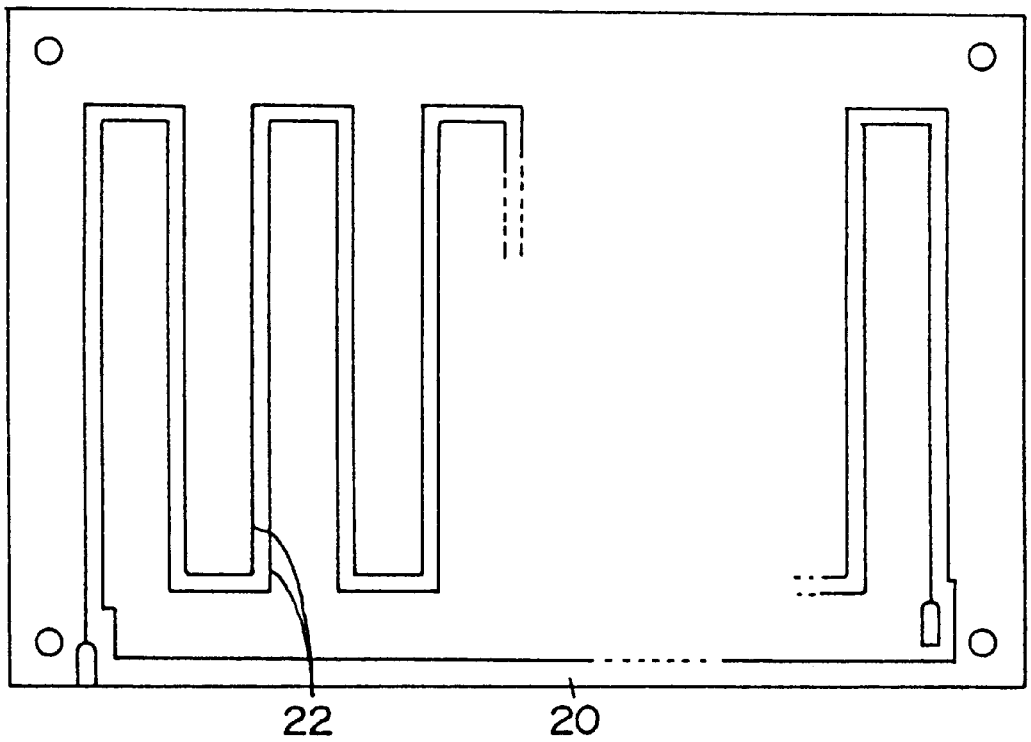
FIG. 4 is an explanatory view showing another example of the vibratory diaphragm.
Figure 5:
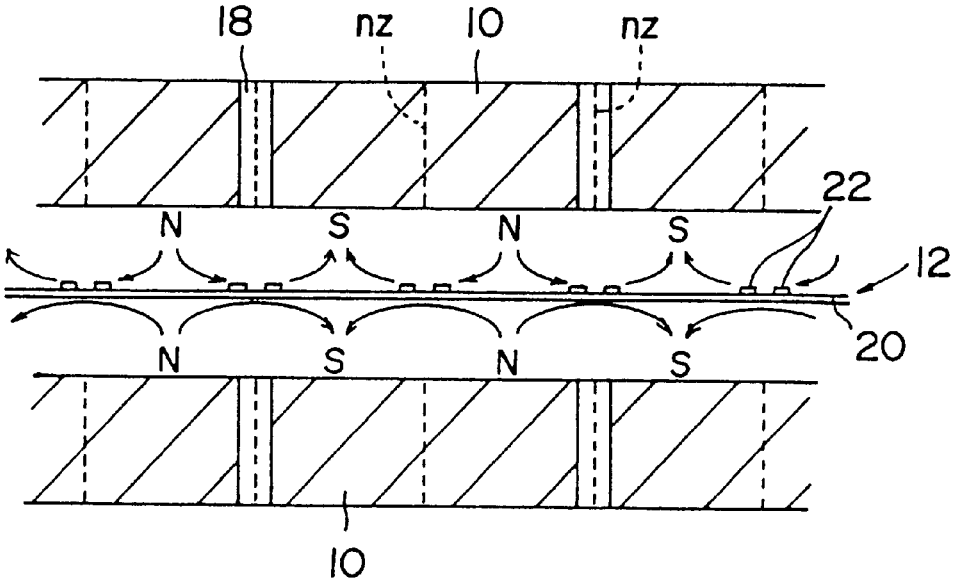
FIG. 5 is a perspective view showing the constructions of permanent magnet plates and a vibratory diaphragm, as well as their positional relationship, according to another embodiment of the present invention.

The conductor pattern serving as the coil may have not only a single turn as shown in FIG. 3 but also plural turns. An example of double turns is shown in FIG. 4. A coil 22 is formed by providing two parallel conductor patterns on the surface of the resin film 20. In case of plural turns, they are arranged in laterally symmetrical relation with respect to the center line of each neutral zone and as close as possible to each other. A relation between the coil 22 and the poles of the permanent magnetic plates 10 in case of double turns is depicted in FIG. 5. By establishing such a relation, the vibrations to be generated by the component of force parallel to the plane occurrable in the conductor pattern displaced from the center line of each neutral zone can be offset. As a consequence, the vibratory diaphragm can be efficiently vibrated in the vertical direction to the plane as much as possible.

Figure 6:
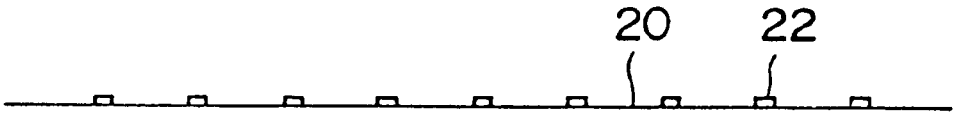
FIG. 6 is a view showing another example of the vibratory diaphragm.
Figure 7:
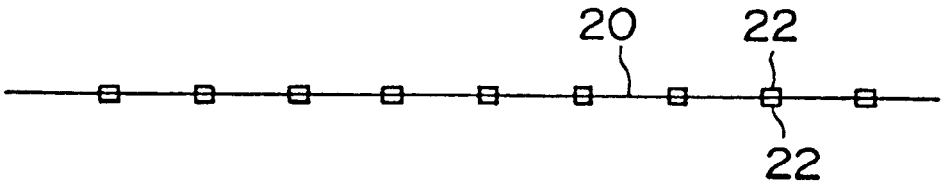
FIG. 7 is a view showing still another example of the vibratory diaphragm.
Figure 8:
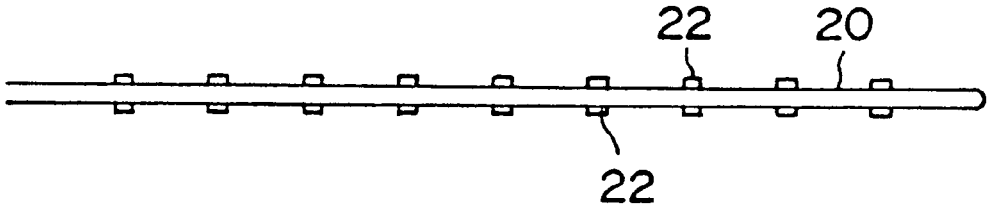
FIG. 8 is a view showing yet another example of the vibratory diaphragm.

As shown in FIG. 6, the vibratory diaphragm may be comprised of the resin film 20 on a single surface of which the coil 22 is formed or on double surfaces of which the coils 22 are formed respectively (see FIG. 7). If necessary, as shown in FIG. 8, the resin film 20 attached with the coil 22 may be overlapped in several layers by folding or other means. However, in case a resin film whose both surfaces are formed with the coils respectively is overlapped or superimposed, it is necessary that a separate insulating film is interposed between the vertically adjacent coil-formed resin films, or the surface of the coil is subjected to insulating treatment, for example.

Figure 9:
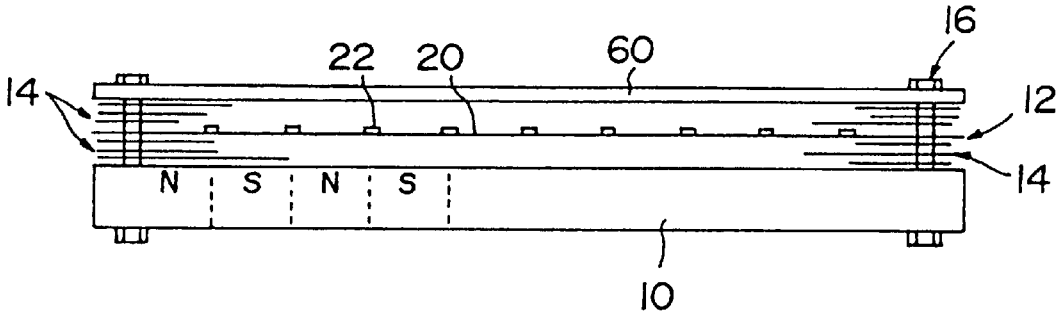
FIG. 9 is an explanatory view showing a thin type electromagnetic transducer according to another embodiment of the present invention.
Figure 10:
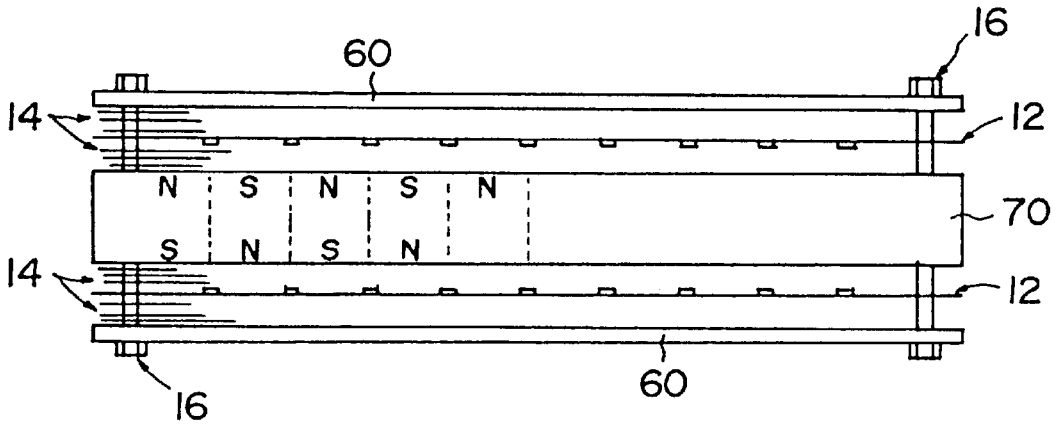
FIG. 10 is a view showing a modified embodiment of the construction of FIG. 9.
Figure 11:
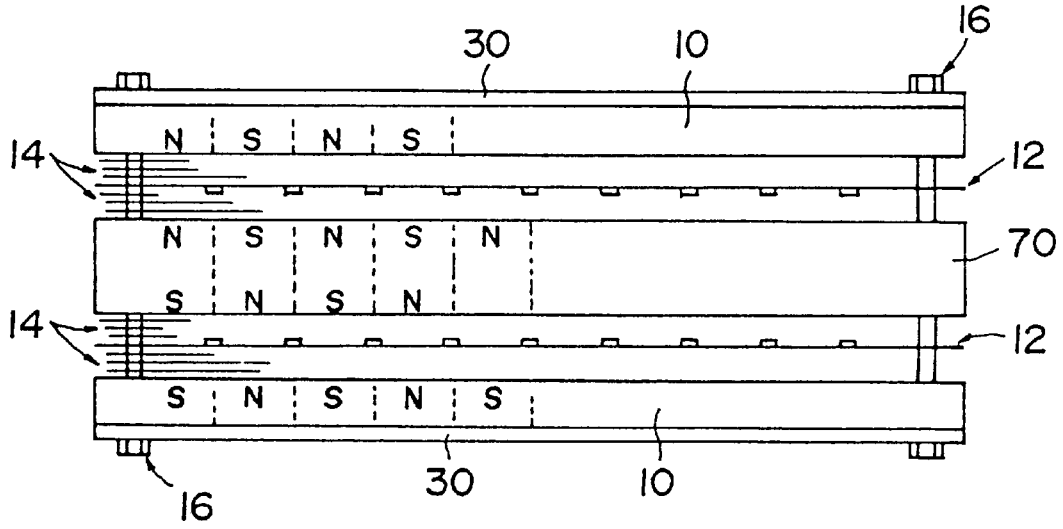
FIG. 11 is a view showing another modified embodiment of the construction of FIG. 9.

FIGS. 9 to 11 show explanatory views of a thin type electromagnetic transducer according to a further embodiment of the present invention. The embodiment shown in FIG. 9 is a single surface drive type of a permanent magnetic plate. On one side (lower side in FIG. 9) of the vibratory diaphragm 12, the permanent magnetic plate 10 is disposed through the cushion member 14, which comprises of a plurality of nonwoven fabrics, and on the other side (upper side in FIG. 9), a perforated presser plate 60 is disposed through the resilient buffer member 14, which is comprised of a plurality of nonwoven fabrics, and the four corners are fixed by the support members 16. For the sake of clarification only, in FIGS. 9 to 11, a large part of the resilient buffer member 14 is omitted but the resilient buffer member 14 is actually generally the same in size as the vibratory diaphragm 12. Needless to say, the vibratory diaphragm 12 and the resilient buffer member 14 are not fixed together at the peripheral region and they can be displaced in a vertical direction as a whole. Although not shown, a magnetic plate having a high magnetic permeability is preferably provided on the lower surface side of the permanent magnetic plate 10.

The thin-structured electromagnetic transducer according to the present invention has many other applications. For example, in case a multipolar magnetizing is applied to each surface of the permanent magnetic plate, as shown in FIG. 10, the vibratory diaphragm 12 may be disposed on each side of the permanent magnetic plate 70. That is, the resilient buffer members 14 are each interposed between the permanent magnetic plate 70 and the vibratory diaphragm 12 and between the vibratory diaphragm 12 and the perforated presser plate 60, and then they are fixed at the corner portions by the support members 16. The fixing can be made in the same manner as discussed with respect to the above embodiment. The permanent magnetic plate 70 and the presser plate 60 are affixed together, but the vibratory diaphragm 12 and the cushion member 14 can displace in the thickness-wise direction. Further, as shown in FIG. 11, a separate permanent magnetic plate 10 may be provided instead of the perforated presser plate 60.

In the construction of FIG. 9, since a provision of only one permanent magnetic plate is good enough, a handy handling can be obtained although a sound pressure to be generated is small. In addition, it can advantageously be reduced in weight and formed in a thinner design. In the construction of FIG. 10, both the vibratory diaphragms can be vibrated simultaneously. In FIG. 11, although the design is somewhat thicker, a sound pressure to be generated can be increased.

The permanent magnetic plate used in the present invention can be suitably selected from other materials than the sintered ferrite magnet. For example, it may be a rare earth based permanent magnet, or an Nd-Fe-B based permanent magnet, or any other metal based magnet. It may be sintered or solid permanent magnet, or it may also be a plastic magnet hardened with use of resin. In a construction in which a plurality of permanent magnetic plates are arranged, different kinds of permanent magnetic plates may be combined. For example, it is acceptable that a sintered magnet is used in the main portion and a plastic magnet is used in the secondary portion. A single permanent plate may be constituted-by bonding a plurality of different kinds of permanent magnetic plates together.

The shape of the permanent magnetic plate, in other words, the shape of the electromagnetic transducer may be circle or oblong, as well as such an angular shape as regular square, rectangular, or the like. Of course, it may be any other desired shape. Since it is of thin design, it may take not only a planar shape but also any desired curved surface shape (for example, swollen curved shape, bent wave-form shape, or the like). The overall thickness is appropriately determined in consideration of structure, state of use, required performance, etc. The largeness of each pole (magnetizing force) in the strip parallel magnetized pattern can likewise be appropriately determined in consideration of state of use, required performance, etc.

The vibratory diaphragm may be of a single sheet structure, or a structure of plural plies of sheets as previously mentioned. Usually, a vibratory diaphragm having a desired coil pattern is made by photo-etching a flexible copper oriented printed film. The coil made integral with the resin sheet by such a print wiring technique may be one turn or plural turns. The coils may be formed on upper and lower surfaces of the resin sheet. In that case, the conductor patterns on the upper and lower surfaces can be connected together by means of such techniques as through-hole. The sectional configuration, material, length, etc. of the conductor pattern are determined by indexing them from design impedance of the loudspeaker, or the like.

Since the present invention uses a multipolar magnetized permanent magnetic plate of rigid structure as discussed above, the inventive thin-structured type electromagnetic transducer can be made easily and accurately and a sufficient mechanical strength can be provided. Also, even a fine magnetized pattern can be formed accurately. Moreover, since the magnetic poles appear only on the surface opposing the vibratory diaphragm, the magnetic lines of force are difficult to run in an non-required direction, the number of the magnetic lines of force interlinked with the coils of the vibratory diaphragm is favorably increased, and the driving efficiency is enhanced. Furthermore, since the magnetized pattern can be formed densely, the space between the permanent magnetic assembly and the vibratory diaphragm can be reduced. This again serves to enhance the transforming efficiency and the electromagnetic transducer as a whole can be formed into a thinner design.

According to the present invention, since the vibratory diaphragm is supported at its peripheral region so that it can be displaced in the thickness-wise direction, no support point is created in the peripheral region. As a consequence, a fidelity reproduction sound to the drive current can be obtained and in addition, a large amplitude can be obtained. Since a resilient buffer member formed of a nonwoven fabric or the like is interposed between the vibratory diaphragm and the permanent magnetic plate, there is no possibility that the vibratory diaphragm hits or strikes the permanent magnets and noises (rattling or trembling sounds), which are not required, can be prevented from occurring.

What is claimed is:

1. A thin-structured electromagnetic transducer comprising:

a permanent magnetic plate including a parallel striped multipolar magnetized pattern of alternating strip N-poles and strip S-poles formed substantially over an entire surface of said permanent magnetic plate, and a plurality of air-discharge through-holes arranged in neutral zones of said magnetized pattern;

a vibratory diaphragm, disposed in opposing relation to said permanent magnetic plate, formed of a thin and soft resin film, and including a printed coil having a serpentine conductor pattern, said conductor pattern including a linear portion disposed in a position corresponding to the neutral zones of said permanent magnetic plate, said vibratory diaphragm being not affixed at a peripheral region of said vibratory diaphragm, wherein said magnetized pattern of said permanent magnetic plate is oriented so as to oppose said vibratory diaphragm;

a support member for supporting said vibratory diaphragm so as to allow displacement of said vibratory diaphragm in a thickness direction of said vibratory diaphragm and so as to restrict displacement of said vibratory diaphragm in a planar direction of said vibratory diaphragm;

a resilient buffer member, interposed between said vibratory diaphragm and said permanent magnetic plate, being formed of plural plies of sheets having a substantially equal size as said vibratory diaphragm, said sheets being soft, having high air-permeability and being oriented so as to form a gap between said sheets and said permanent magnetic plate or between said sheets and said vibratory diaphragm.

2. A thin-structured electromagnetic transducer according to claim 1, comprising a plurality of said permanent magnetic plate and a plurality of said resilient buffer, wherein one of said plurality of said permanent magnetic plate and one of said plurality of said resilient buffer are disposed on one side of said vibratory diaphragm, and another of said plurality of said permanent magnetic plate and another of said resilient buffer are disposed on another side, opposite to said one side, of said vibratory diaphragm, in such a manner as to sandwich said vibratory diaphragm between said one of said plurality of resilient buffer and said another of said plurality of said resilient buffer, and said one of said plurality of permanent magnetic plates and said another of said permanent magnetic plates are affixed with a space therebetween with the neutral zones of said magnetized pattern of said one of said plurality of said permanent magnetic plate in alignment with the neutral zones of said magnetized pattern of said another of said plurality of said permanent magnetic plate and with like poles of said one of said plurality of said permanent magnetic plate and said another of said plurality of said permanent magnetic plate in mutually opposing relation.

3. A thin-structured electromagnetic transducer according to claim 2, further comprising:

a magnetic flux leakage preventive magnetic plate, having a high magnetic permeability, in intimate contact with a surface of at least one of said permanent magnetic plates opposite to a surface facing said vibratory diaphragm; and a plurality of air discharge holes, formed in at least one of said permanent magnetic plates, in communication with said air-discharge through-holes in said at least one permanent magnetic plate.

4. A thin-structured electromagnetic transducer according to claim 1, wherein said vibratory diaphragm is formed of a resin film and includes a serpentine conductor pattern formed on each side of said resin film.

5. A thin-structured electromagnetic transducer according to claim 4, further comprising:

a magnetic flux leakage preventive magnetic plate, having a high magnetic permeability, in intimate contact with a surface of at least one of said permanent magnetic plates opposite to a surface facing said vibratory diaphragm; and a plurality of air discharge holes, formed in at least one of said permanent magnetic plates, in communication with said air-discharge through-holes in said at least one permanent magnetic plate.

6. A thin-structured electromagnetic transducer according to claim 1, further comprising:

a magnetic flux leakage preventive magnetic plate, having a high magnetic permeability, in intimate contact with a surface of at least one of said permanent magnetic plates opposite to a surface facing said vibratory diaphragm; and a plurality of air discharge holes, formed in at least one of said permanent magnetic plates, in communication with said air-discharge through-holes in said at least one permanent magnetic plate.

* * * * *